US012022922B1

(12) United States Patent
Lu

(10) Patent No.: US 12,022,922 B1
(45) Date of Patent: Jul. 2, 2024

(54) EASY-TO-DISASSEMBLE LENGTH-ADJUSTABLE CHAIN STRAP

(71) Applicant: Shenzhen Qipurui Technology Co., Ltd., Shenzhen (CN)

(72) Inventor: Haibing Lu, Shenzhen (CN)

(73) Assignee: Shenzhen Qipurui Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/418,258

(22) Filed: Jan. 20, 2024

(30) Foreign Application Priority Data

Dec. 27, 2023 (CN) ..... 202323571127.2

(51) Int. Cl.
*A44C 5/10* (2006.01)
*A44C 5/00* (2006.01)

(52) U.S. Cl.
CPC ..... *A44C 5/107* (2013.01); *A44C 5/0061* (2013.01)

(58) Field of Classification Search
CPC ..... A44B 11/258; A44B 11/2584; A44B 11/2588; A44B 11/263; A44B 5/2052; A44B 5/2071; A44B 5/2066; A44C 5/107; A44C 5/0061; G04B 37/1486; Y10T 24/4782
See application file for complete search history.

(56) References Cited

U.S. PATENT DOCUMENTS 5,038,557 A * 8/1991 Otsuki ..... A44C 5/107 63/4
5,711,056 A * 1/1998 Taguchi ..... A44C 5/24 24/69 J
7,849,569 B2 * 12/2010 Cope ..... A44C 5/2042 63/3.1
9,693,608 B1 * 7/2017 Rota ..... F16G 15/04
2005/0014541 A1 * 1/2005 Clerc ..... A44C 5/2071 455/575.1
2018/0132570 A1 * 5/2018 Chen ..... A41F 1/002

FOREIGN PATENT DOCUMENTS

CN 213720312 U 7/2021
CN 113768254 A 12/2021
CN 114145547 A 3/2022

* cited by examiner

*Primary Examiner* — Jack W Lavinder
(74) *Attorney, Agent, or Firm* — Nitin Kaushik

(57) ABSTRACT

The present invention relates to the field of chain straps, in particular to an easy-to-disassemble length-adjustable chain strap, including: several middle chain links, wherein one end of each middle chain link is inserted with a connecting needle with an end exposed to the outside of the middle chain link; and one part of each pulling component is fitted into each middle chain link, and the other part of the pulling component is rotatably inserted into one edge link I correspondingly. According to the present invention, the length of the chain strap can be easily and conveniently adjusted by hand without using any tools under normal conditions. The way of adjusting the length of the chain strap is: gently pulling the edge link I outward with fingers and then rotating the same at a small angle to directly disassemble two adjacent middle chain links.

10 Claims, 5 Drawing Sheets

EASY-TO-DISASSEMBLE LENGTH-ADJUSTABLE CHAIN STRAP

CROSS-REFERENCE TO RELATED APPLICATIONS

The application claims priority to Chinese patent application No. 2023235711272, filed on Dec. 27, 2023, the entire contents of which are incorporated herein by reference.

TECHNICAL FIELD

The present invention relates to the technical field of chain straps, and in particular to an easy-to-disassemble length-adjustable chain strap.

BACKGROUND

Chain straps are commonly used to connect a watch or a piece of jewelry. The chain strap is adjustable in a preset position, which enables accurate repositioning. In the usual case, a connecting piece of the chain strap is provided with a device or a component that adjusts the length of the chain strap so that the chain strap meets the circumference requirements of a wrist of a wearer.

At present, with the exception of some adjustment of the length of the wristwatch chain strap of an attachment device (or buckled intermediate element), a watch chain can be replaced more or less easily without the use of special tools. Although no special tools are required to replace the watch chain, and such a replacement can therefore be done by a user, it may be difficult to manipulate the attachment device.

The adjustment of the length of the wristwatch chain strap is carried out by means of specialized tools, for example by ejecting the connecting needle by means of a strap disassembling tool. The disassembly process, although simple in appearance, is very unfriendly. If an inexperienced user performs the disassembly, the connecting needle will be ejected in the wrong direction or ejected so hard that it is removed. There is a case where the connecting needle is not assembled in place due to the user being inexperienced, resulting in the scenario that the connecting needle is dropped out and the strap particles are loosened.

In view of this, there are many inconveniences in using specialized tools to operate and adjust the length of the watch chain, and it is necessary to provide more convenient and fast disassembly solutions for replacements.

SUMMARY

The object of the present invention is to provide an easy-to-disassemble length-adjustable chain strap to solve the problem proposed in the background art.

In order to achieve the above object, the present invention provides the following technical solutions:

an easy-to-disassemble length-adjustable chain strap, including:

several middle chain links, wherein one end of each middle chain link is inserted with a connecting needle, and an end of the connecting needle is exposed to an outside of the middle chain link;

several pulling components, one part of each pulling component being correspondingly fitted into each middle chain link, and the other part of the pulling component being correspondingly rotatably inserted into one edge link I; and applying a dragging force to each edge link I, and driving the pulling component to move along a direction parallel to the axial direction of the connecting needle via the edge link I, so that the edge link I is away from the corresponding middle chain link, and so that the edge link I is disengaged from one of the exposed ends of the connecting needle on the adjacent middle chain link;

wherein when the edge link I is away from the corresponding middle chain link, and the pulling component in the edge link I generates one acting force in an opposite direction to an applied dragging force; and after the edge link I is disengaged from one of the exposed ends of the connecting needle on the adjacent middle chain links, the edge link I can be relatively rotated with a movable pulling component located in it, thereby staggering the edge link I from one of the exposed ends of the connecting needle on the adjacent middle chain links, and the edge link I is brought close to the corresponding middle chain link again by the acting force after the removal of the applied dragging force.

Further, the pulling component includes a rotary pin, one end of the rotary pin is inserted into the corresponding middle chain link, an elastic member I is sleeved on the rotary pin at an end, and the other end of the rotary pin is rotatably inserted into a corresponding edge link I.

Further, the rotary pin is "T"-shaped and the corresponding middle chain link is provided with a "T"-shaped groove body for accommodating the rotary pin and the elastic member I sleeved thereon.

Further, each middle chain link is further provided with an edge link II, and the edge link II is inserted onto the other exposed end of a corresponding connecting needle, the edge link I being provided with an end groove for accommodating one of the exposed ends of the connecting needle of the adjacent middle chain links.

Further, the edge link II is provided with a positioning pin inserted into the corresponding middle chain link.

Further, two middle chain links, whose ends are close to each other, are connected in a hinged manner with end chain links I, the two end chain links I being connected and disassembled by means of a clamping component.

Further, the clamping component comprises a connecting piece in hinged connection with one of the end chain links I and a covering member in hinged connection with the other end chain link I, the covering member being provided therein with a frame body, the frame body being provided therein with pressing members capable of pressing and springing apart from each other, and the connecting piece being provided thereon with a projection capable of snap-in engagement with the pressing members.

Further, a through groove I is provided on the frame body, a through groove II is provided on the pressing member, an elastic member II is provided between the two pressing members, a hook part is provided in the through groove II, the projection can pass through the through groove II and the through groove I, and a barb snap-fitted with the hook part is provided on the projection.

Further, two pressing members have a button protruding towards the back side, the covering member and a side face of the frame body have a side groove for the button to pass through, and an area of the through groove II is greater than an area of the through groove I.

Further, two middle chain links, whose ends are away from each other, are in hinged connection with an end chain link II; and two end chain links II are attached to an object, which is a wearable item, including but not limited to a watchcase and a jewelry.

Compared with the prior art, the beneficial effects of the present invention are as follows.

According to the present invention, the length of the chain strap can be easily and conveniently adjusted by hand without using any tools under normal conditions. The way of adjusting the length of the chain strap is: gently pulling the edge link I outward with fingers and then rotating the same at a small angle to directly disassemble two adjacent middle chain links, so that the length of the chain strap can be easily adjusted.

This structure is easy to disassemble and replace, and it fundamentally breaks and replaces the traditional chain strap, which has defects such as requiring the help of tools to disassemble the strap particles (i.e. a single middle chain link, and its edge link, edge link II, and connecting needle), scraping other accessories when removing and replacing are conducted, and requiring an operator to have a little watch knowledge. Therefore, the strap particles are easy to disassemble and convenient, and it is not easy to scrape other accessories. It has good stability. This structure is not only used for the chain strap of metal connecting particles, but also used for the hard tape particles, metal mesh chain straps, the connection of the watchcase and the chain strap, etc.

According to the present invention, two middle chain links, whose ends are close to each other, are connected in a hinged manner with an end chain link I, the two end chain links I being connected again and disassembled rapidly by means of a clamping component.

Figure 1:
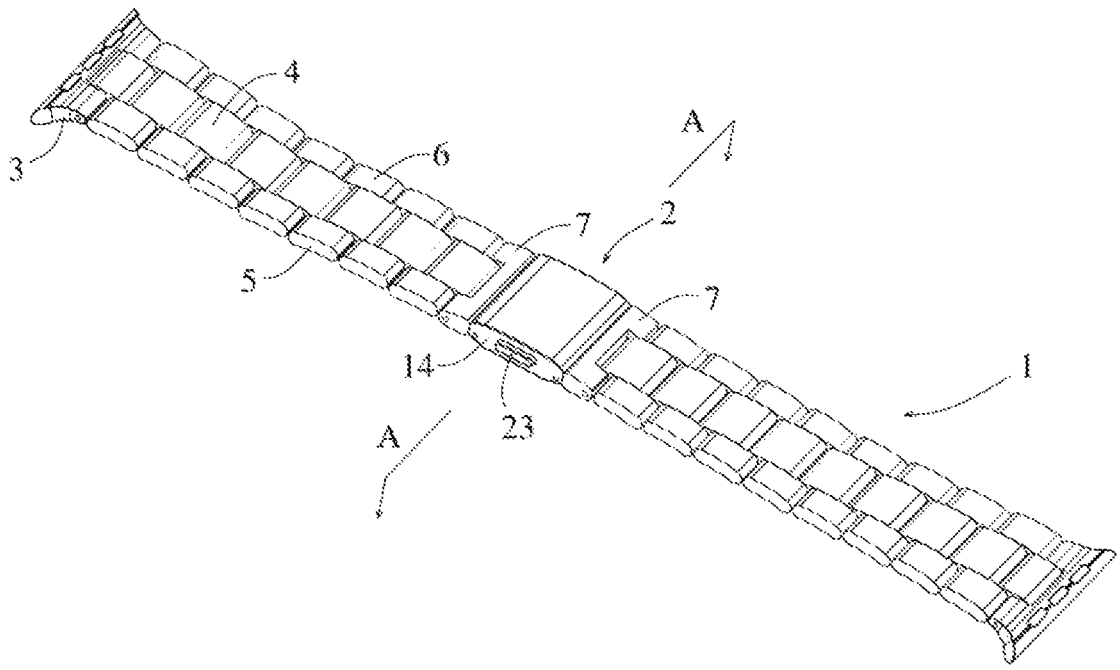
FIG. 1 is a schematic structural view of the present invention.

In the drawings: 1—chain strap, 2—clamping component, 3—end chain link II, 4—middle chain link, 5—edge link I, 6—edge link II, 7—end chain link I, 8—rotary pin, 9—elastic member I, 10—connecting needle, 11—groove body, 12—end groove, 13—positioning pin, 14—covering member, 15—connecting piece, 16—frame body, 17—pressing member, 18—hook part, 19—through groove I, 20—through groove II, 21—projection, 22—barb, 23—button, 24—elastic member II, 25—side groove, 26—pulling component, 27—magnet block, and 28—connecting needle hole.

DETAILED DESCRIPTION OF THE EMBODIMENTS

The technical solutions in the embodiments of the present invention will be clearly and completely described below in conjunction with the accompanying drawings in the embodiments of the present invention. Obviously, the described embodiments are only a part of the embodiments of the present invention, rather than all the embodiments. Based on the embodiments of the present invention, all other embodiments obtained by one of ordinary skills in the art without involving any inventive effort are within the scope of the present invention.

In the description of the present invention, it needs to be noted that the orientation or positional relationships indicated by the terms "upper end", "lower end", "inner", "outer", "front end", "rear end", "two ends", "one end", "the other end", etc. are based on the orientation or positional relationship shown in the drawings, and are only for the convenience of describing the invention and simplifying the description, rather than indicating or implying that the referred device or element must have a specific orientation, or be constructed and operated in a specific orientation, and therefore cannot be construed as a limitation of the present invention. Furthermore, the terms "first" and "second" are only used for descriptive purposes and are not to be construed as indicating or implying relative importance.

In describing the present invention, it needs to be noted that unless otherwise expressly specified and limited, the terms "mount", "provided", "sleeved", "sleeve connection", "connected", etc. should be interpreted broadly. For example, "connected" can be a fixed connection or a detachable connection, or an integrated connection; it can be a mechanical connection, or an electrical connection; it can be directly connected or indirectly connected through an intermediate medium, and it can be the communication within two elements. For a person of ordinary skills in the art, the specific meaning of the above-mentioned terms in the present invention can be understood according to specific situations.

Referring to FIGS. 1 to 5, the present invention provides a technical solution:

an easy-to-disassemble length-adjustable chain strap, including:

several middle chain links 4, wherein one end of each middle chain link 4 is inserted with a connecting needle 10, and the end of the connecting needle 10 is exposed to the outside of the middle chain link 4;

several pulling components 26, one part of each pulling component 26 being correspondingly fitted into each middle chain link 4, and the other part of the pulling component 26 being correspondingly rotatably inserted into one edge link I 5; and applying a dragging force to each edge link I 5, and driving the pulling component 26 to move along a direction parallel to the axial direction of the connecting needle 10 via the edge link I 5, so that the edge link I 5 is away from the corresponding middle chain link 4, and so that the edge link I 5 is disengaged from one of the exposed ends of the connecting needle 10 on the adjacent middle chain link 4;

wherein when the edge link I 5 is away from the corresponding middle chain link 4, the pulling component 26 in the edge link I 5 generates one acting force in the opposite direction to the application of the dragging force; and after the edge link I 5 is disengaged from one of the exposed ends of the connecting needle 10 on the adjacent middle chain links 4, the edge link I 5 can be relatively rotated with a movable pulling component 26 located in it, thereby staggering the edge link I 5 from one of the exposed ends of the connecting needle 10 on the adjacent middle chain links 4, and the edge link I 5 is brought close to the corresponding middle chain link 4 again by the acting force after the removal of the applied dragging force.

The present invention, as shown in FIG. 1, includes several middle chain links 4, which together with the edge link I 5, connecting needle 10, and edge link II 6, etc. constitute one chain strap 1. This middle chain links 4 are rotated relative to each other for comfortable wear.

According to the present invention, the length of the chain strap 1 can be easily and conveniently adjusted by hand without using any tools under normal conditions.

By providing the pulling component 26, it is possible to disconnect and reconnect between adjacent middle chain links 4. Specifically, the pulling component 26 comprises a rotary pin 8, one end of the rotary pin 8 is inserted into a corresponding middle chain link 4, an elastic member I 9 is sleeved on the rotary pin 8 at the end, and the other end of the rotary pin 8 is rotatably inserted into a corresponding edge link I 5.

The rotary pin 8 is in a "T" shape, and the corresponding middle chain link 4 is provided with a "T"-shaped groove body 11 for accommodating the rotary pin 8 and the elastic member I 9 sleeved on it.

In particular, each middle chain link 4 is also provided with an edge link II 6. The edge link II 6 is inserted onto the other exposed end of the corresponding connecting needle 10, and the edge link I 5 is provided thereon with an end groove 12 for accommodating one of the exposed ends of the connecting needle 10 on the adjacent middle chain links 4. The middle chain link 4 is provided thereon with a connecting needle hole 28 for the connecting needle 10 to be inserted in a penetrating way.

The edge link II 6 is provided with a positioning pin 13 inserted into the corresponding middle chain link 4.

Figure 2:
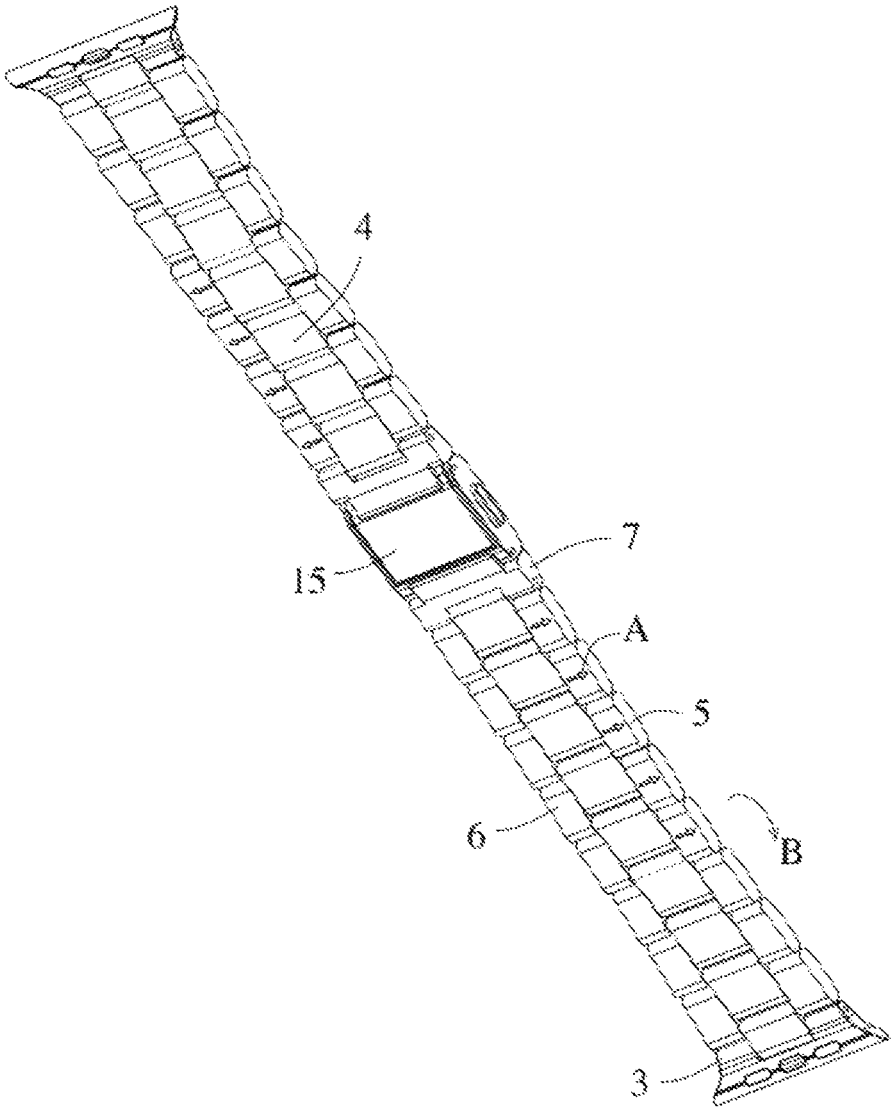
FIG. 2 is a schematic bottom view of the present invention.

As shown in FIG. 2, the edge link I 5 is movable on one side of the middle chain link 4. In particular, it can be pulled in the direction of arrow A in the drawing and can rotate in the direction of the arrow B (rotating by taking the rotary pin 8 as the rotating shaft); the edge link II 6 on the other side of the middle chain link 4 is relatively fixed, and in particular, it is sleeved on one of the two exposed ends of the connecting needle 10, and is provided with a positioning pin 13 so that the edge link II 6 is relatively fixed and cannot rotate relative to the middle chain link 4.

Figure 3:
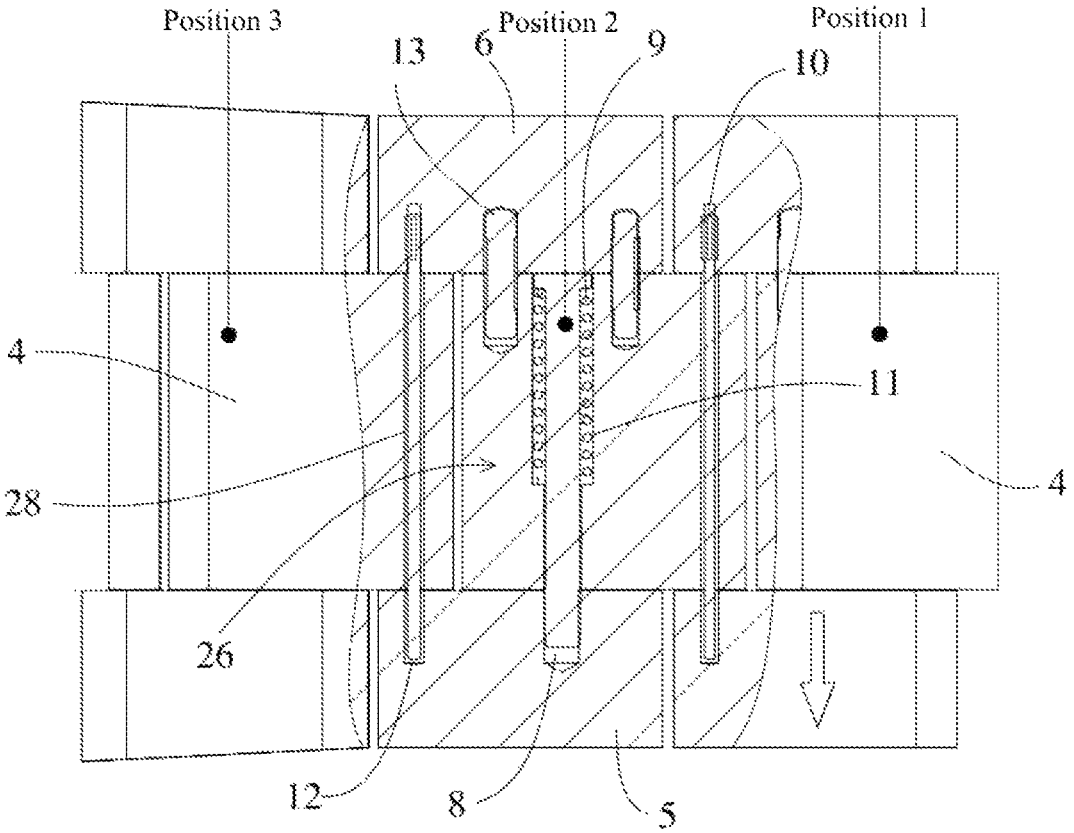
FIG. 3 is a partial cross-sectional view of a chain strap of the present invention.

As shown in FIG. 3, when the length of the chain strap 1 needs to be adjusted, a dragging force can be applied by pinching any three edge links I 5 with fingers, so as to pull it towards the outer side (i.e. pulling in the direction of the arrow A in FIG. 2), and continue to pull until the edge link I 5 disengages from the exposed end of the connecting needle 10 inserted on the adjacent edge links 15, I.e. the exposed end of the connecting needle 10 disengages from the end groove 12; at this moment, the edge link I 5 is gently rotated (i.e. rotated in the direction of the arrow B in FIG. 2) so that the edge link I 5 is staggered from the exposed end of the (adjacent) connecting needle 10; in this process, since the edge link I 5 simultaneously pulls the rotary pin 8, the elastic member i 9, preferably a helical spring, which is sleeved on the rotary pin 8 is compressed, which will generate one elastic force (or acting force).

The length of the chain strap 1 can be adjusted by releasing the fingers, and by pulling back the edge link I 5 against the side face of the corresponding middle chain link 4 by means of an elastic force (or the acting force) after the applied dragging force is removed. The specific operation is as follows:

when the edge links I 5 in position 1, position 2, and position 3 in FIG. 3 are all rotated by a certain angle, the connecting needle 10 of the middle chain link 4 (including the edge link I 5 and the edge link II 6 on it) in position 1 is withdrawn from the connecting needle hole 28 of the middle chain link 4 in position 2, and the middle chain link 4 in position 1 is removed;

then the connecting needle 10 of the middle chain link 4 (including the edge link I 5 and the edge link II 6 on it) in position 2 is withdrawn from the connecting needle hole 28 of the middle chain link 4 in position 3, and the middle chain link 4 in position 2 is removed; and finally, the connecting needle 10 of the middle chain link 4 (including the edge link I 5 and the edge link II 6 on it) removed at position 1 is inserted into the connecting needle hole 28 at position 3, and then each edge link I 5 rotated by a certain angle is pulled to the outer side in turn; and after the end groove 12 on the edge link I 5 is aligned with the exposed end of the adjacent connecting needles 10, the hand is released, and the hinged connection between the middle chain link 4 and the middle chain link 4 can be realized again under the acting force of the elastic member i 9.

In this way of adjusting the length of the chain strap 1, the length of the chain strap 1 can be easily adjusted by using fingers to gently pull the edge link I 5 outwards and then rotating the same by a small angle, so as to directly disassemble the two adjacent middle chain links 4. This structure is easy to disassemble and replace, and it fundamentally breaks and replaces the traditional chain strap 1, which has defects such as requiring the help of tools to disassemble the strap particle modules (i.e. the middle chain link 4, and its edge link I 5, edge link II 6, and connecting needle 10), scraping other accessories when removing and replacing are conducted, and requiring an operator to have a little watch knowledge. Therefore, the strap particles are easy to disassemble and convenient, and it is not easy to scrape other accessories. It has good stability. This structure is not only used for the chain strap of metal connecting particles, but also used for the hard tape particles, metal mesh chain straps, the connection of the watchcase and the chain strap, etc.

In particular, two middle chain links 4, the ends of which are close to each other, are connected in a hinged manner with the end chain link I 7, the two end chain links I 7 being connected and disassembled by means of a clamping component 2.

The clamping component 2 includes a connecting piece 15 in hinged connection with one of the end chain links I 7 and a covering member 14 in hinged connection with the other end chain link I 7, the covering member 14 being provided therein with a frame body 16, the frame body 16 being provided therein with pressing members 17 capable of pressing and springing apart from each other, and the connecting piece 15 being provided thereon with a projection 21 capable of snap-in engagement with the pressing member 17.

A through groove I 19 is provided on the frame body 16, a through groove II 20 is provided on the pressing member 17, an elastic member II 24 is provided between the two pressing members 17, a hook part 18 is provided in the through groove II 20, the projection 21 can pass through the through groove II 20 and the through groove I 19, and the projection 21 is provided thereon with a barb 22 which cooperates with the hook part 18 and is clamped.

The two pressing members 17 have a button 23 protruding towards the back side, the covering member 14 and the side face of the frame body 16 have a side groove 25 for the button 23 to pass through, and the area of the through groove II 20 is greater than the area of the through groove I 19.

Figure 4:
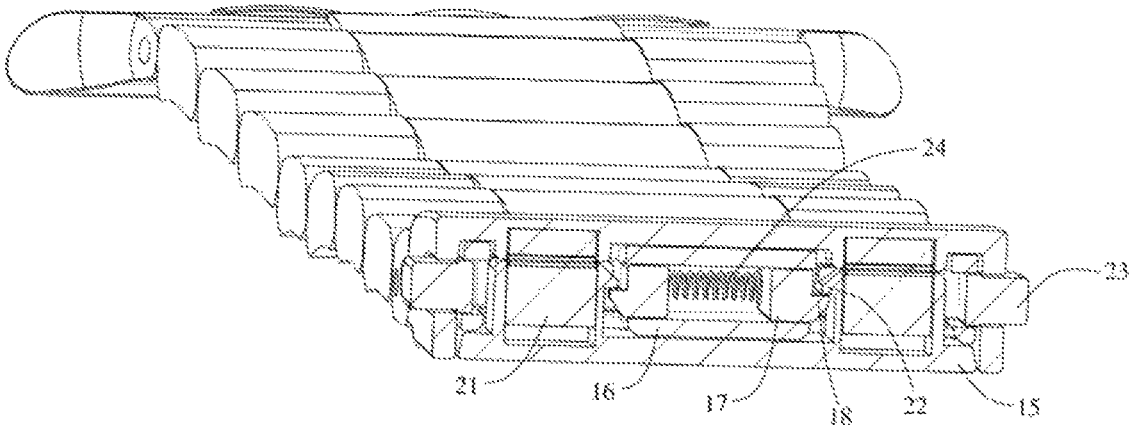
FIG. 4 is a schematic sectional view at A-A of FIG. 1 of the present invention.
Figure 5:
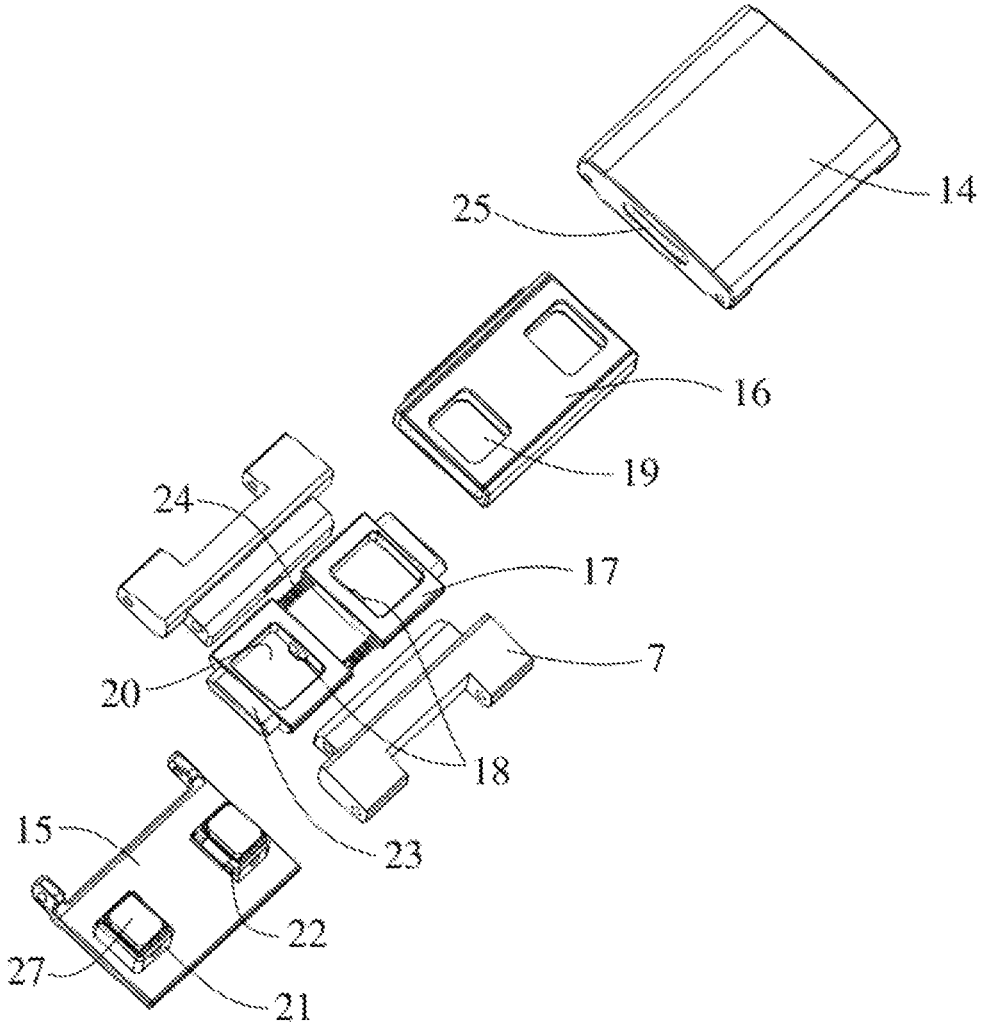
FIG. 5 is a schematic explosive view of a clamping component of the present invention.

As shown in FIGS. 4 and 5, when it is required to detach the two end chain links I 7, firstly, two fingers, such as a thumb and an index finger, a thumb and a middle finger, are used to inwardly pinch two protruding buttons 23, and the buttons 23 are inwardly contracted along the side groove 25 until they are retracted into the covering member 14 (and the frame body 16); at this time, the interval between the hook parts 18 in the through grooves II 20 on the two pressing members 17 is less than the interval between the barbs 22 of the two projections 21 on the connecting piece 15, then the covering member 14 is covered to the connecting piece 15, the two hook parts 18 are located below the two barbs 22, and then the two fingers are released; and the two pressing members 17 are pushed back into position under the action of the elastic force generated by the compression of the elastic member II 24, preferably a helical spring, so that the two hook parts 18 are hooked with the two barbs 22 to form a snap-fit state, and the two protruding buttons 23 re-protrude out of the covering member 14, thereby re-realizing the snap-fit connection between the two end chain links I 7.

If the covering member 14 is of a material that can be attracted by a magnet or is embedded with a magnet, correspondingly, a magnet block 27 is also provided on the projection 21.

Since the position of the through groove I 19 is relatively fixed and the through groove II 20 varies somewhat in the plane direction, it is necessary that the area of the through groove II 20 is larger than the area of the through groove I 19. Such an arrangement is intended to realize the scenario that the process of pinching the protruding button 23, retracting the button 23 into the covering member 14 (and the frame body 16) and re-protruding the same out of the covering member 14 does not affect the two projections 21 sequentially inserting into the through groove II 20 and the through groove I 19.

In particular, the two middle chain links 4, with the ends away from each other, are connected in a hinged manner with the end chain link II 3. The two end chain links II 3 are attached to an object, which is a wearable item, including but not limited to a watchcase and a piece of jewelry.

While embodiments of the present invention have been shown and described, it will be understood by those skilled in the art that various changes, modifications, substitutions, and alterations may be made to these embodiments without departing from the principles and spirit of the present invention, and the scope of the present invention is limited by the attached claims and equivalents thereof.

What is claimed is:

1. An easy-to-disassemble length-adjustable chain strap, comprising:

several middle chain links (4), wherein one end of each middle chain link (4) is inserted with a connecting needle (10), and an end of the connecting needle (10) is exposed to an outside of the middle chain link (4);

several pulling components (26), wherein a first part of each pulling component (26) is correspondingly fitted into each middle chain link (4), and a second part of the pulling component (26) is correspondingly rotatably inserted into a first edge link (5); and wherein when applying a dragging force to each first edge link (5), the pulling component (26) is driven by the first edge link (5) to move in a direction parallel to an axial direction of the connecting needle (10), so that the first edge link (5) is away from a corresponding middle chain link (4), and so that the first edge link (5) is disengaged from a first exposed end one of exposed ends of the connecting needle (10) on an adjacent middle chain link (4); and after the first edge link (5) is disengaged from the first exposed ends of the connecting needle (10) on the adjacent middle chain links (4), the first edge link (5) can be relatively rotated with the pulling component (26), thereby staggering the first edge link (5) from the first exposed ends of the connecting needle (10) on the adjacent middle chain links (4), and the first edge link (5) is brought close to the middle chain link (4) again by an acting force after a removal of the dragging force, wherein the acting force is generated by the pulling component (26) in the first edge link (5) when the first edge link (5) is away from the middle chain link (4), and the acting force is in an opposite direction to the dragging force.

2. The easy-to-disassemble length-adjustable chain strap according to claim 1, wherein the pulling component (26) comprises a rotary pin (8), a first end of the rotary pin (8) is inserted into the middle chain link (4), a first elastic member (9) is sleeved on the rotary pin (8) at an end, and a second end of the rotary pin (8) is rotatably inserted into a corresponding first edge link (5).

3. The easy-to-disassemble length-adjustable chain strap according to claim 2, wherein the rotary pin (8) is "T"-shaped and the middle chain link (4) is provided with a "T"-shaped groove body (11) for accommodating the rotary pin (8) and the first elastic member (9) sleeved thereon.

4. The easy-to-disassemble length-adjustable chain strap according to claim 1, wherein each middle chain link (4) is further provided with a second edge link (6), and the second edge link-edge link (6) is inserted onto the other a second exposed end of the connecting needle (10), the first edge link-edge link (5) being provided with an end groove (12) for accommodating the first exposed ends of the connecting needle (10) of the middle chain links (4).

5. The easy-to-disassemble length-adjustable chain strap according to claim 4, wherein the second edge link (6) is provided with a positioning pin (13) inserted into the middle chain link (4).

6. The easy-to-disassemble length-adjustable chain strap according to claim 1, further comprising two first end chain links (7) connected to one another by a clamping component (2).

7. The easy-to-disassemble length-adjustable chain strap according to claim 6, wherein the clamping component (2) comprises a connecting piece (15) in hinged connection with one of the first end chain links I (7) and a covering member (14) in hinged connection with another first end chain link of the first end chain links (7), the covering member (14) being provided therein with a frame body (16), the frame body (16) being provided therein with pressing members (17) capable of pressing and springing apart from each other, and the connecting piece (15) being provided thereon with a projection (21) capable of snap-in engagement with the pressing members (17).

8. The easy-to-disassemble length-adjustable chain strap according to claim 7, wherein a first through groove (19) is provided on the frame body (16), a second through groove (20) is provided on the pressing members (17), an elastic member II (24) is provided between the two pressing members (17), a hook part (18) is provided in the second through groove (20), the projection (21) can pass through the second through groove (20) and the first through groove (19), and a barb (22) snap-fitted with the hook part (18) is provided on the projection (21).

9. The easy-to-disassemble length-adjustable chain strap according to claim 8, wherein two pressing members (17) have a button (23) protruding towards a back side, the covering member (14) and a side face of the frame body (16) have a side groove (25) for the button (23) to pass through, and an area of the second through groove (20) is greater than an area of the first through groove (19).

10. The easy-to-disassemble length-adjustable chain strap according to claim 1, and further comprising two second end chain links (3) attached to an object, which is a wearable item.

* * * * *